US006481990B2

(12) United States Patent
Wong et al.

(10) Patent No.: US 6,481,990 B2
(45) Date of Patent: Nov. 19, 2002

(54) HYDRAULICALLY BALANCED MULTI-VANE HYDRAULIC MOTOR

(75) Inventors: Tom Cheuk-In Wong, Saginaw, MI (US); Johnny M. Paris, Clio, MI (US); Albert Cheuk-Yin Wong, Saginaw, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/814,677

(22) Filed: Mar. 21, 2001

(65) Prior Publication Data

US 2002/0136655 A1 Sep. 26, 2002

(51) Int. Cl.[7] ..... F03C 4/00

(52) U.S. Cl. ..... 418/82; 418/133; 418/132; 418/268; 418/75; 418/77

(58) Field of Search ..... 418/133, 268, 418/77, 75, 82

(56) References Cited

U.S. PATENT DOCUMENTS

| | | | | |
|---|---|---|---|---|
| 2,842,064 A | * | 7/1958 | Wahlmark | 418/133 |
| 3,752,609 A | * | 8/1973 | Niemiec et al. | 418/133 |
| 4,008,002 A | * | 2/1977 | Niemiec et al. | 418/133 |
| 4,505,654 A | * | 3/1985 | Dean, Jr. et al. | 418/133 |
| 4,913,636 A | * | 4/1990 | Niemiec | 418/268 |
| 5,266,018 A | * | 11/1993 | Niemiec | 418/268 |
| 5,470,215 A | | 11/1995 | Stone | |
| 5,702,243 A | | 12/1997 | Gerlach | |
| 6,050,796 A | | 4/2000 | Wong et al. | |

FOREIGN PATENT DOCUMENTS

| | | | |
|---|---|---|---|
| JP | 04-339187 | * 11/1992 | 418/133 |

OTHER PUBLICATIONS

"Fluid Power Theory and Applications", Third Edition, pp. 189–190, James A. Sullivan, 1989.

* cited by examiner

*Primary Examiner*—Thomas Denion
*Assistant Examiner*—Theresa Trieu
(74) *Attorney, Agent, or Firm*—Edmund P. Anderson

(57) ABSTRACT

A multi-vane hydraulic motor for accessory drive in which the vanes of a hydraulically balanced rotor are primarily urged into operative engagement with a surrounding cam by forces of the hydraulic fluid in undervane passage produced by an associated hydraulic pump to eliminate requirement for biasing springs and spring attachment of prior art motor. A high pressure chamber provided between the motor housing and a pressure plate mounted therein is hydraulically connected to the vane chambers of the rotor of the motor for the hydraulic drive thereof. An end cap closing the motor housing has the hydraulic input and output lines operatively connected thereto.

7 Claims, 5 Drawing Sheets

PRIOR-ART

FIG-5A
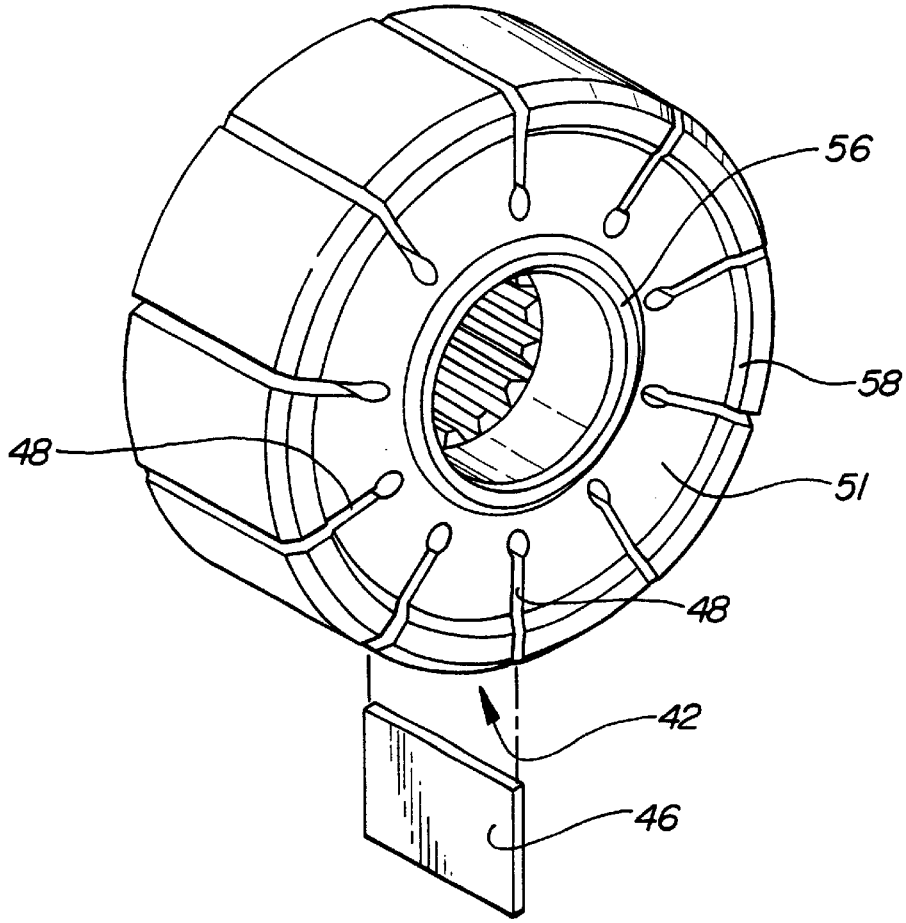
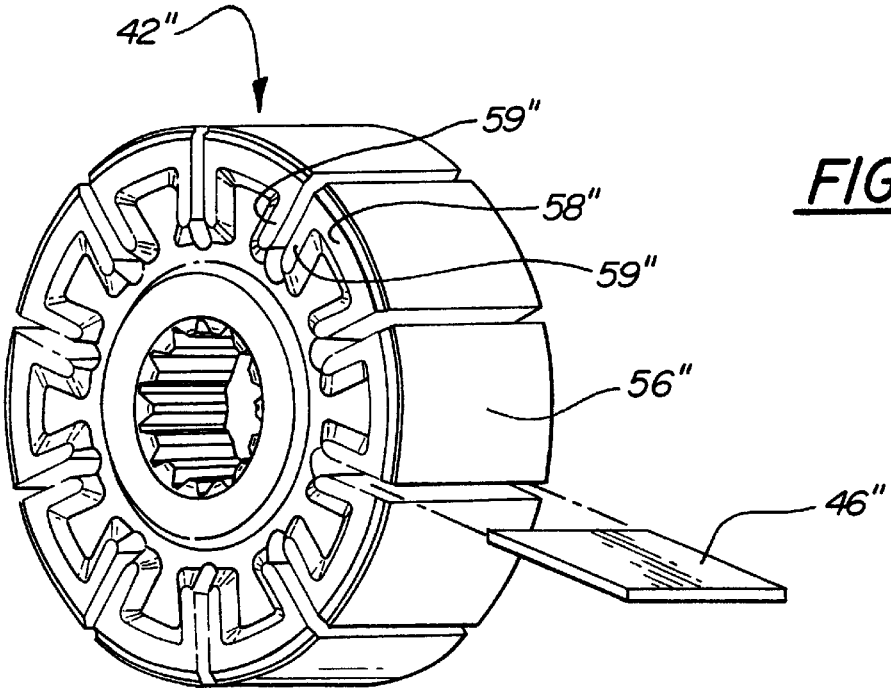
FIG-5B

HYDRAULICALLY BALANCED MULTI-VANE HYDRAULIC MOTOR

FIELD OF THE INVENTION

This Invention relates to hydraulically powered motors for accessory drives and more particularly to a new and improved multi-vane hydraulic motor with a hydraulically balanced rotor for improved high pressure performance and advanced pressurization of the undervane for quick and effective motor priming and efficient motor operation.

DESCRIPTION OF RELATED ART

Prior to the present invention a variety of hydraulic motors have been devised to provide improved drives in various systems such as the hydraulic accessory drive system in automotive vehicles. Many of such motors are multi-vane units that utilize a rotor with an arrangement of outwardly-extending and reciprocally-movable vanes that have cooperating springs for exerting a yieldable outward spring force on the vanes. This force fully maintains the vanes in good sealing and sliding contact with a surrounding outer cam for efficient motor operation. Some problems have been experienced with some motors with vane biasing springs in high cyclic and high speed operation. For example, the vane springs for engine cooling fan drive motors may fatigue and have shortened service life because of high speed and cycle actions during vehicle operation. Such spring fatigue may cause poor motor performance or break down.

FIG. 7 of the drawings of this application illustrates one prior art motor with spring biased radial vanes. Other examples are illustrated and described in U.S. Pat. No. 5,470,215 issued Nov. 28, 1995 to Stephen Stone for Wear Resistant Vane-Type Fluid Power Converter and U.S. Pat. No. 5,702,243 issued Dec. 30, 1997 to C. Richard Gulach for Hydraulic Motor with Pressure Compensated End Plates.

While such prior art hydraulic motors have generally met their objectives in providing improved operating characteristics, more economical and efficient motors are needed to meet requirements for a wider range of applications and to meet higher standards from an efficiency, service life and cost standpoints. Moreover, manufacture and assembly of prior art motors with their special vane and spring constructions are tedious, difficult and costly. New and improved motors are needed to alleviate such problems.

BRIEF SUMMARY OF THE INVENTION

In contrast to the prior art multi vane hydraulic motors exemplified above, the present invention provides a new and improved hydraulic motor of straight-forward construction with effective and efficient routing of hydraulic motor drive pressures for quickly stroking the vanes into operative sliding-sealing engagement with a surrounding cam surface for quick motor priming. With the hydraulic biasing of the vanes of this invention, wear is materially reduced. This invention furthermore advantageously utilizes a minimal number of components particularly as compared to the prior art constructions with spring biased vanes.

This invention accordingly provides for the effective elimination of vane springs with the optimized employment of hydraulic forces instead of mechanical spring forces for yieldably stroking or urging the vanes into operative sealing engagement with an outer cam ring. Moreover with the quick stroking or "pop out" of vanes with high pressure hydraulics, initially fed at elevated points on the pressure grade curve to the undervane, the specialized prior art vanes and springs and their mechanical attachment are no longer required for quick and optimized motor priming. With the effective elimination of such springs and their attachment constructions, potential sources of motor wear and breakdown are eliminated.

In this invention high pressure hydraulic fluid from a hydraulic pump feeds into the inlet port of the motor and then into the high pressure side chambers or balancing pockets formed on opposing sides of the rotor of the motor. These side chambers are interconnected by the undervane passages so that a hydraulic pressure on opposing sides of the rotor is the same and rotor balancing is achieved. With such balanced rotor, motor breakdowns such as from rotor seizure experienced by prior unbalance rotors is minimized. The undervane passages in the rotor are formed at the inner ends of outwardly extending slots in the rotor. The vanes are mounted for reciprocal movement in these slots and the outer tips thereof operatively engage the cam surface of a surrounding cam ring mounted in the motor housing. The porting of high pressure flow into the rotor balancing chambers and interconnecting undervane passages of the rotor further forces the vanes outwardly and the tips of the vanes against the interior contour of the outer cam ring to effect an optimized sliding fluid seal.

In one preferred embodiment of this invention, an open ended housing is provided in which a specialized disk-like pressure plate is fixed at a predetermined distance from an internal end wall as determined by radial inner and outer o-ring seals to define a high pressure drive chamber therebetween located at one side of the rotor. The rotor is operatively mounted within the housing on an output shaft which extends axially therefrom for driving an accessory such as an engine cooling fan. The housing is closed by an end plate fixed thereto at the other side of the rotor which is formed with the inlet and outlet passages therein for the connection of hydraulic input and return lines thereto.

As the rotor is rotatably driven by the feed of pressurized hydraulic fluid from the high pressure drive chamber through one or more routing passages in the pressure plate into the vane chambers, the vanes reciprocate in their slots to establish an endless series of sealed rotor-drive chambers between adjacent vanes. These chambers serially receive pressure fluid from the system pump via the internal passages in the motor including the rotor balancing pressure chambers and the connecting undervane passages that feed into the high pressure drive chamber through inner passages in the pressure plate. The vane chambers subsequently discharge such fluid into an exhaust passage system in the end or cover plate and then to the return line operatively connected thereto.

The flow through the vane chambers with minimized leakage past the vane tip and cam seal effects rotation of the rotor and attached output shaft for accessory drive. Importantly in this invention the undervane passages receive pump pressure at high and optimum points on the pressure gradient for exerting an equal and outward force on each of the vanes optimizing and equalizing vane fluid sealing and wear. With improved vane-cam ring wear and sealing, pump operation is optimized.

BRIEF DESCRIPTION OF THE DRAWING

These and other features, objects and advantages of the invention will become more apparent from the following detailed description and drawings in which.

DETAILED DESCRIPTION

Figure 1:
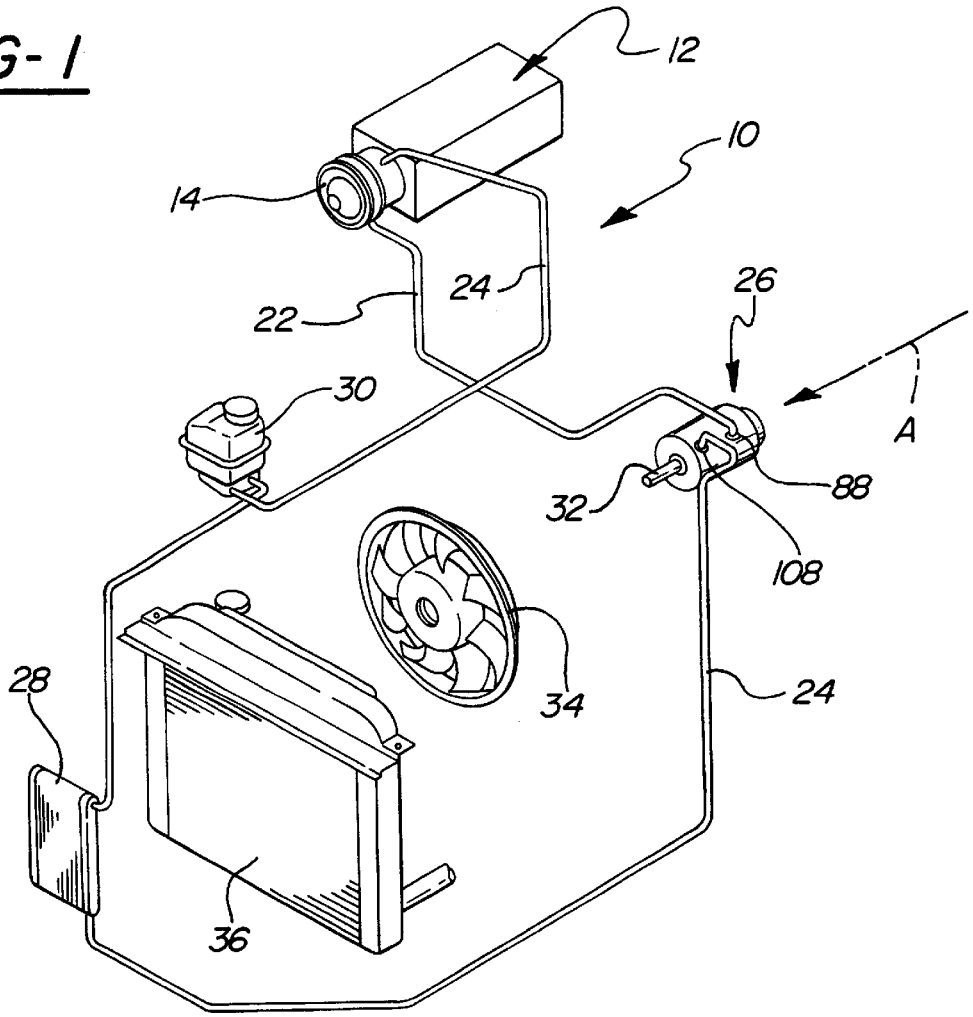
FIG. 1 is a diagrammatic view of a hydraulic pump and motor system employed in a vehicle for driving accessories.

Turning now in greater detail to the drawing there is schematically shown in FIG. 1 a vehicle engine cooling fan drive system 10 that is operatively integrated into the hydraulic power steering gear drive 12. The steering gear drive includes a hydraulic pump 14, that may be common to both power steering and fan drives and is driven by the vehicle engine, not shown. In addition to powering the power steering gear, the pump 14 is operatively connected by supply line 22 and return line 24 to power a hydraulic motor 26. The return line 24 connects back into the pump 14 via to a fluid cooling radiator 28 and reservoir 30 as schematically shown. Controls for controlling the flow to the motor are not shown. The motor 26 may be supplied with pressure fluid from a pump dedicated thereto if desired.

The hydraulic motor 26 has an elongated, stepped-diameter output shaft 32 that rotatably drives a shrouded engine cooling fan 34 that effects the flow of air through an engine cooling radiator 36 operatively connected to a liquid cooled internal combustion engine, not shown, for engine cooling purposes. The hydraulic motor 26, details of which are best shown in FIGS. 2–6, comprises a generally cylindrical shell-like housing 38 which defines a cavity 40 in which a rotor 42 is operatively mounted. More particularly, the rotor is splined or otherwise mounted on the stepped diameter output shaft 32 that has it's innermost end rotatably mounted in bushing 43 or other suitable bearing supported in a mating cylindrical recess 41 in an end cover plate of the motor housing described hereinafter.

The output shaft 32 is further rotatably supported in the housing by a suitable bearing unit 39 axially spaced in the housing from the bushing 43. A main lip seal 45 is mounted in a cylindrical recess in an outer extending cylindrical neck portion of the housing for annular sealing contact with the outer surface the output shaft.

The rotor, drivingly mounted by splines at its centralized inner bore to the output shaft 32, is a generally cylindrical component formed with a circular periphery 44. The periphery is of predetermined width matching the width of flattened, blade-like rotor vanes 46 associated with the rotor. The vanes 46 are operatively mounted in a plurality of generally linear slots 48 that preferably project radially in the rotor from a circular arrangement of inner and transversely extending undervane hydraulic passages 50. Other slot arrangements, such as slots that are off center from the axis of rotor rotation may be used as desired.

The passages 50 extend from one side of the rotor to the other to hydraulically connect rotor balancing chambers 51 and 53 formed on opposite sides of the rotor described below. With a hydraulically balanced rotor 42, rotor seizing is reduced or eliminated and motor operating efficiency is increased. When these balancing chambers and the connecting undervane hydraulic passages 50 are pressurized, the pressurized fluid in the undervanes exerts an equal outward force on each of the vanes for effecting the equal operative engagement of each the vane tips with the interior surface 52 of a cam ring 54. The cam ring is securely fixed in the housing by dowel pins 55 and surrounds the rotor.

Figure 3A:
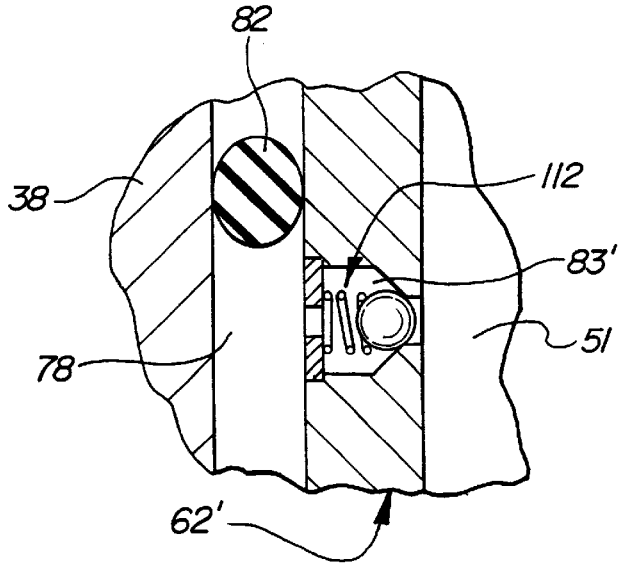
FIG. 3*a* is an enlarged portion of the encircled part of FIG. 3 modified to illustrate an alternative structure of the invention.
Figure 2:
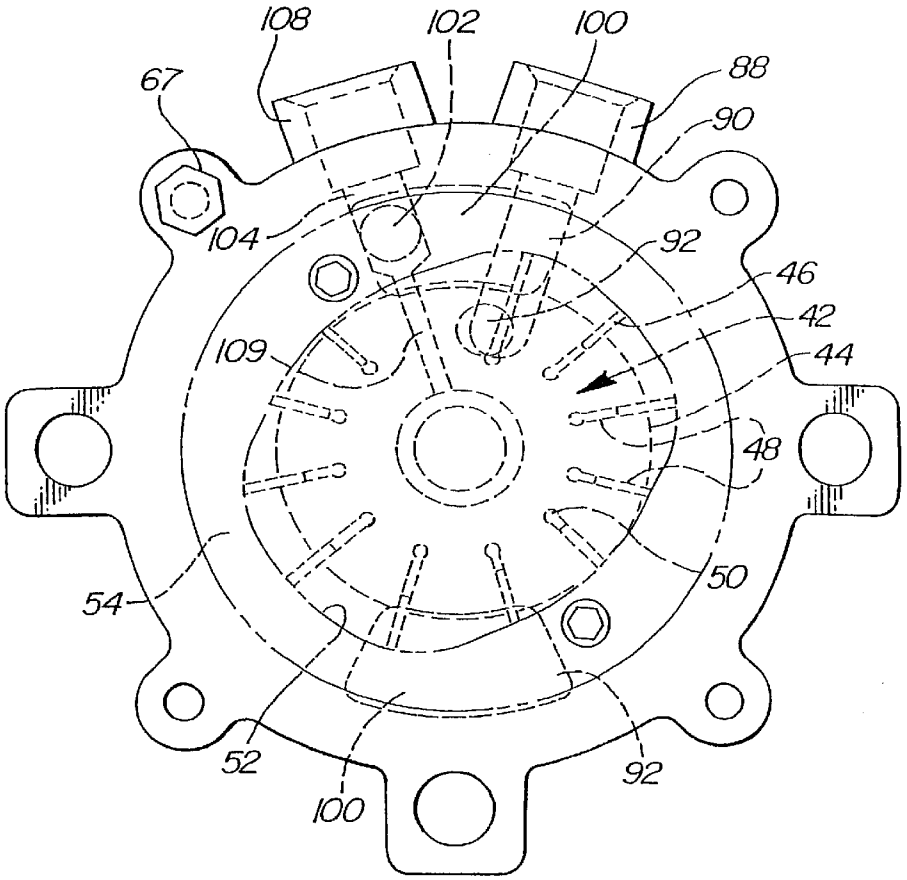
FIG. 2 is an end view of the hydraulic motor of FIG. 1 sight arrow A of FIG. 1 but with the pressure inlet port rotated out of position.
Figure 3:
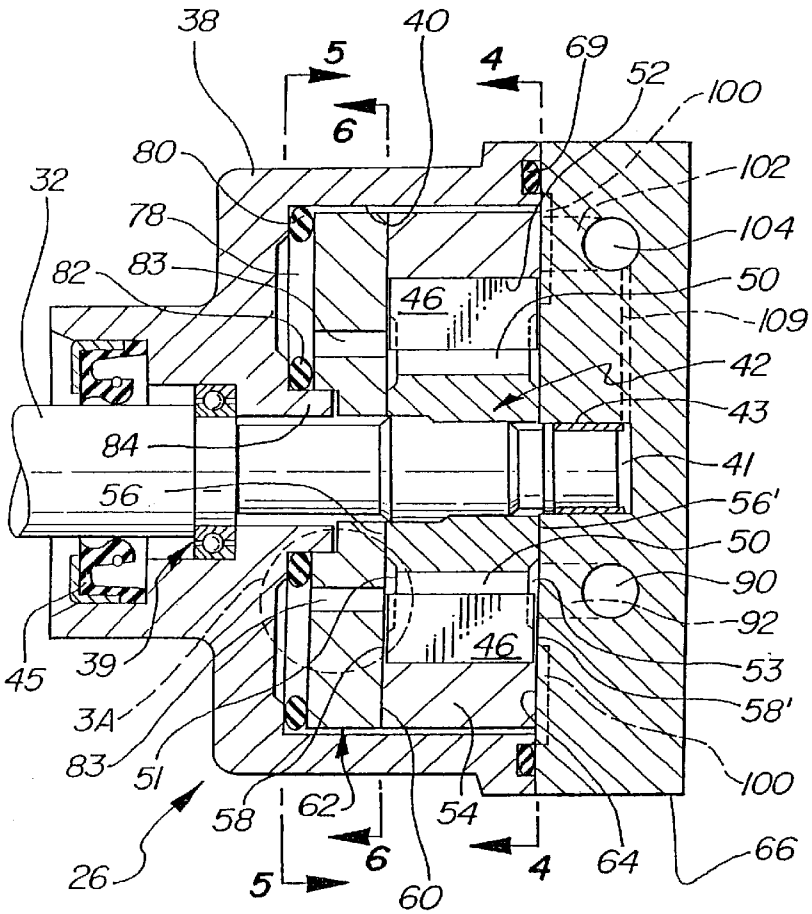
FIG. 3 is a cross sectional view of FIG. 2 but with some parts shown in full lines.
Figure 4:
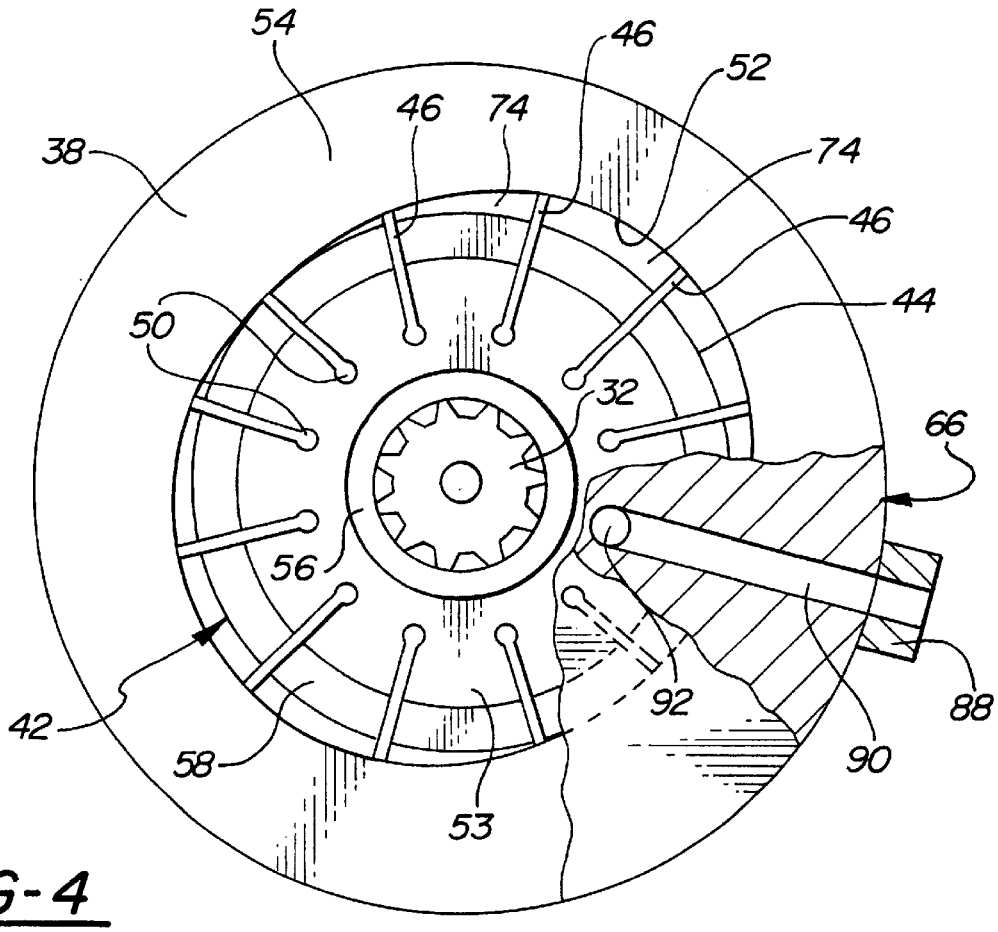
FIG. 4 is a sectional view taken generally along sight lines 4—4 of FIG. 3 but with some parts shown in full lines and broken away.
Figure 6:
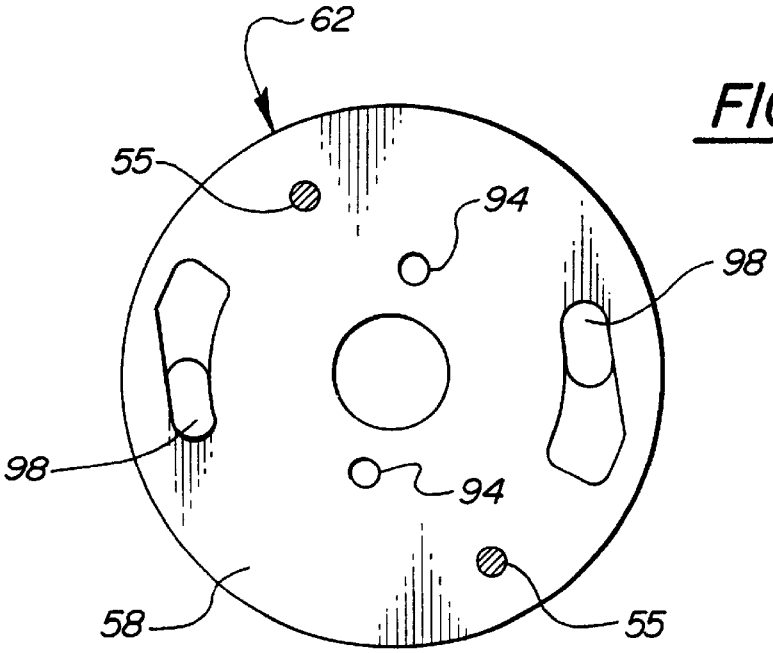
FIG. 6 is a view of the pressure plate of the motor taken generally along sight lines 6—6 of FIG. 3.
Figure 5:
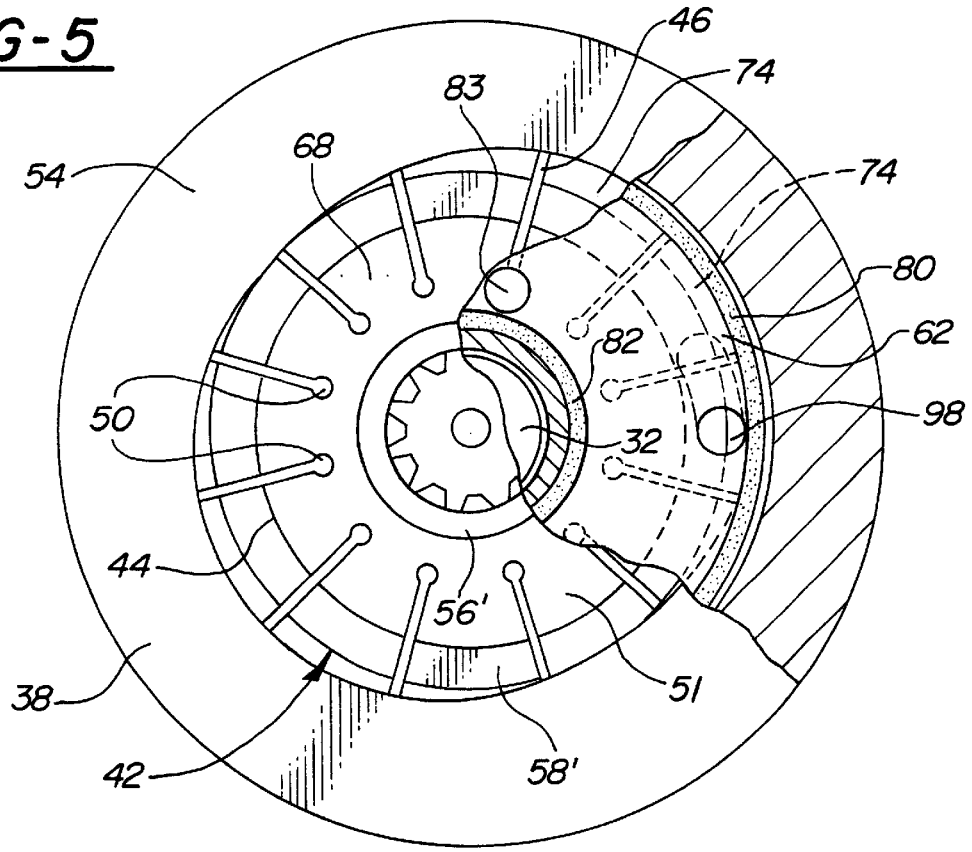
FIG. 5 is a sectional view taken generally along sight lines 5—5 of FIG. 3 but with some parts shown in full lines and broken away.
Figure 7:
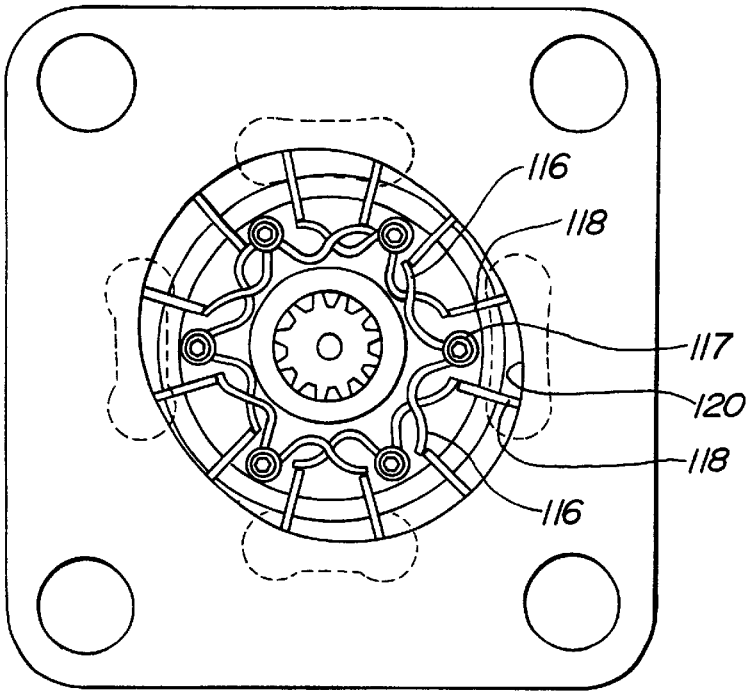
FIG. 7 is a sectional view of a prior art spring-biased radial vane hydraulic motor.

As best shown in FIGS. 3, 4 and 5, the opposite sides of the rotor 42 are formed with preferably concentric inner and outer annular lands 56 and 58 and 56' and 58' that respectively cooperate with the flattened inner faces 60 of a disc-like pressure plate 62 mounted within the housing 38 by dowel pins 55 and the opposing flattened face 64 of a cover plate cover or end plate 66 that closes the housing. Threaded fasteners such as illustrated by reference numeral 67 in FIG. 2 secure the cover plate to the housing. While O-ring seal 69 provides fluid sealing between these two components. With the cover plate 66 secured to the housing 38, the fluid pressure chambers 51, 53 are formed between the annular lands on opposite sides of the rotor for rotor balancing purposes. Pressure fluid for motor operation is supplied from pump 14 via supply line 22 which connects into a hydraulic fitting 88 on cover plate 66. The fitting connects to the radial passage 90 and transverse leg 92 in the cover plate for feeding high pressure fluid into the rotor balancing chambers and the interconnecting undervane.

The adjacent reciprocally movable vanes 46 further cooperate with the outer periphery of the rotor and the inner cam surface of the cam ring to define vane pressure chambers 74 in the motor so that the feed of high pressure hydraulic fluid thereto effects rotation of the rotor and thereby the drive of the fan. In FIG. 5 for instance, the high pressure of hydraulic fluid supplied to vane chambers 74 exerts a counter clockwise force on the rotor as it flows to the low pressure of the exhaust because of the area differential of adjacent vanes defining each vane chamber established by the cam surface as is well known in this art.

Fluid for driving the rotor is fed from high pressure drive chamber 78 (FIG. 3) formed in housing 38 between the pressure plate 62 and the facing end wall of the housing. The radial outer and inner limits of the high pressure chamber 78 are provided by outer and inner seal rings 80 and 82 of elastomer or other suitable material. The high pressure chamber 78 is supplied with pressure fluid by a pair of radially inner passages 83 in the pressure plate 62 for the direct feed of hydraulic fluid from the side rotor balancing chamber 51 into the high pressure drive chamber 78.

As shown in FIG. 3, seal ring 82 is operatively mounted on an inner cylindrical neck 84 of the body of the housing and between the pressure plate and the facing inner wall of the housing. The outer sealing ring 80 is mounted between the pressure plate and the facing inner wall of the housing. With the high pressure drive chamber 78 established high pressure fluid is provided for feed through the vane chambers for the drive of the rotor.

Pressure fluid in the high pressure drive chamber is forced through one or more outer radial passages 98 in the fixed pressure plate (FIG. 5) and into the vane chambers 74 as they turn and serially pass such passages. These vane chambers exhaust as they pass arcuate discharge ports 100 cut or otherwise formed in the inner face of the cover plate. Pressure fluid discharged into ports 100 will flow back into low pressure such as provided by the exhaust or return line 24 through the transverse passage 102 and connected radial passage 104 in the cover plate. Passage 104 is connected by fitting 108 to the end portion of the return line 24.

The radial bleed line 109 also formed in the cover plate connects the central opening 41 in the cover plate mounting the sleeve bearing 43 therein relieves the pressure in the opening for the output shaft 32 to provide relief and protection of the main seal 45 and for the circulating of the hydraulic fluid that act as a lubricating oil for the shaft and bearings.

In FIG. 3A, a modification to the motor primarily involving changes to the pressure plate is disclosed. In this modification the pressure plate 62' is provided with spring-biased check valves 112 in the radially inner passages 83' leading to the high pressure rotor drive chamber. This check valve construction opens from the force of a predetermined pressure acting on the ball valve element of the check valve for effecting the build up of high pressure in the pressure balancing chambers for improved rotor balancing. Also the increased undervane pressure optimizes "pop out" of the vanes 46 to operatively engage the cam before the high pressure drive chamber 78 is fully charged.

In any event with this invention the motor vanes will be quickly "popped out" in response to the delivery of the high pressure from the pump 14 at a high point on the pressure gradient curve. With such response, the employment of spring devices such as vane springs 116 and their threaded rotor attachment fasteners 117 of FIG. 9 effecting the engagement of the vanes 118 with the cam 120 is not required. Moreover with the present invention, the force applied to each of the vanes is equal so that vane wear is equal for enhanced vane cam ring sealing and increased service life. With the prior vane spring and connections eliminated, unit build is simplified and motor performance is maintained at an optimized level with minimized breakdown.

Having described and illustrated preferred embodiments of this invention, various changes and modifications to the embodiments or the inventive concepts disclosed therein may be apparent to those skilled in the art without departing from the spirit or scope of the invention.

We claim:

1. A multi-vane hydraulic motor comprising a housing, a cover secured in a fluid tight manner to said housing to define a hydraulic chamber therein, a rotatable output shaft operatively mounted for rotation in said housing having one end piloted in said cover and an opposite end extending outwardly from said housing, a rotor operatively mounted within said hydraulic chamber for rotatably driving said output shaft, a cam ring secured in said housing surrounding said rotor, said rotor having an outer peripheral surface facing said cam ring, a plurality of vane slots extending laterally through said rotor and outwardly through said peripheral surface of said rotor, a vane mounted for reciprocating motion in each of said slots having an undersurface at the inner end that cooperates with said slots to define an undervane pressure passage and a tip at the outer end that cooperates with the cam ring to define a sliding fluid seal, said vanes cooperating with said cam ring to define vane chambers between adjacent vanes, a pressure plate operatively mounted in said housing adjacent to and in fixed side-by-side relationship with said rotor, said rotor being disposed axially between said cover and said pressure plate, said pressure plate cooperating with said housing to define a high pressure drive chamber and cooperating with said rotor to define a rotor balancing pressure chamber at one side of said rotor, said pressure plate having an inner opening for feeding pressure fluid from said rotor balancing pressure chamber into said high pressure drive chamber and an outer opening for feeding pressure fluid from said high pressure drive chamber directly into said vane chambers to effect the rotational drive of said rotor in said housing.

2. The multi-vaned hydraulic motor of claim 1 and further comprising another rotor balancing pressure chamber formed between said rotor and said cover, and wherein said undervane pressure passages hydraulically interconnect said pressure balancing pressure chambers and said cover has a hydraulic input passage connecting into one of said pressure balancing chambers, and said cover having a hydraulic outlet passage for exhausting fluid from said vane chambers.

3. A multi-vane hydraulic motor comprising a shell-like housing, an end cap secured in a fluid tight manner to said housing to define a hydraulic chamber therein, a rotatable output shaft operatively mounted for rotation in said housing, a generally cylindrical rotor secured to said output shaft for rotation therewith and for rotation within said chamber, a cam ring having an inner cam surface secured in said housing surrounding said rotor, said rotor having a plurality of undervane fluid passages extending transversely through said rotor, a plurality of slots associated with said fluid passages extending through said rotor in a radial outward direction from said fluid passages, a flattened vane mounted for reciprocating motion in each of said vane slots and having an undersurface that cooperates with said undervane slots and said passages to define undervane pressure chambers, each of said vanes having a tip at the outer end thereof to define a sliding seal with respect to said cam ring, said vanes and said cam ring cooperatively defining an endless series of vane chambers, a pressure plate operatively mounted in said housing defining a high-pressure drive pressure chamber, side chambers formed between said end cap and said rotor and said pressure plate and said rotor for receiving pressure fluid, a fluid input leading into said end cap, said end cap having an inner opening for feeding pressure to said undervane pressure chambers to effect the simultaneous urging of all of said vanes into sliding and sealing contact with said cam surface of said cam ring, said pressure plate having an radially inner opening for feeding fluid flowing through said undervane pressure chambers into said high pressure drive chamber and a radially outer opening for feeding high pressure from said drive chamber into said vane chambers for the rotatable drive of said rotor.

4. The motor of claim 3 wherein said high pressure drive chamber is defined between said pressure plate and said housing and further between inner and outer O-ring seals radially disposed with respect to one another.

5. The motor of claim 3 wherein said end cap has a hydraulic return line operatively connected thereto and wherein said side chambers are disposed between inner and outer lands on opposite sides of said rotor for pressure balancing said rotor.

6. A hydraulic motor comprising a housing, a cover secured in a fluid tight manner to said housing to define a hydraulic chamber therein, said cover having a hydraulic fluid inlet passage and a hydraulic fluid outlet passage therein, a rotatable output shaft operatively mounted for rotation in said housing having one end piloted in a centralized opening in said cover and an opposite end extending outwardly therefrom said housing, a main fluid seal operatively mounted in said housing having an annular elastomer seal element sealingly engaging said output shaft, a rotor secured to said shaft operatively mounted for rotation therewith and within said hydraulic chamber, a cam secured in said housing defining an annular cam surface to surround said rotor, said rotor having a peripheral outer surface facing said cam surface, a plurality of vane slots extending outwardly from a circular arrangement of origin points in said rotor through the periphery of said rotor, a vane mounted for reciprocating motion in each of said slots having an undersurface at the inner end that cooperates with said slots to define undervane pressure slot and a tip at the outer end that cooperates with the annular cam surface to define a sliding seal, a pressure plate operatively mounted in said housing adjacent to and in fixed relationship to said rotor, said pressure plate having an inner opening for feeding some of the pressure fluid from the vane chamber into an undervane side pressure chamber and an outer opening for feeding pressure from said high pressure chamber to said vane chambers to effect the rotation of said rotor and said output shaft, said cover having a hydraulic fluid bleed line connecting said centralized opening in said cover for the end of said output shaft to bleed pressure fluid from said centralized opening and said main fluid seal.

7. The hydraulic motor of claim 6 wherein said pressure plate is formed with a ball check valve in said passage connecting said side chamber to said high pressure chamber to effect the build up in said side pressure chambers and said undervanes to a predetermined pressure before opening to said high pressure chamber.

* * * * *